US010429123B1

(12) United States Patent
Stoops et al.

(10) Patent No.: US 10,429,123 B1
(45) Date of Patent: Oct. 1, 2019

(54) REFRIGERATOR APPLIANCE AND DOOR ASSEMBLY HAVING AN INTERIOR PANEL

(71) Applicant: Haier US Appliance Solutions, Inc., Wilmington, DE (US)

(72) Inventors: Alisa Marie Stoops, Louisville, KY (US); Bagawathkumar Chellappan, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/961,967

(22) Filed: Apr. 25, 2018

(51) Int. Cl.
*F25D 23/02* (2006.01)
*F25D 23/08* (2006.01)

(52) U.S. Cl.
CPC ..... *F25D 23/02* (2013.01); *F25D 23/082* (2013.01); *F25D 23/087* (2013.01); *F25D 2323/023* (2013.01)

(58) Field of Classification Search
CPC ..... F25D 23/02; F25D 23/028; F25D 23/082; F25D 23/087; F25D 2323/02; F25D 2323/023
See application file for complete search history.

(56) References Cited

U.S. PATENT DOCUMENTS 3,403,477 A * 10/1968 Light ..... F25D 23/028 49/478.1
3,411,243 A * 11/1968 Baermann ..... F25D 23/087 49/478.1
3,732,646 A 5/1973 Horvay et al.
4,583,796 A * 4/1986 Nakajima ..... F25D 23/02 312/296
4,829,652 A * 5/1989 Haas ..... B23P 19/047 29/235
5,271,671 A * 12/1993 Mandel ..... F25D 23/082 312/296
5,941,624 A * 8/1999 Pfeffer ..... F25D 23/02 312/405.1
6,672,693 B2 * 1/2004 Kawakami ..... A47B 95/02 16/436
6,779,859 B2 * 8/2004 Koons ..... F25D 23/021 312/405
6,804,915 B2 * 10/2004 Holmqvist ..... F25D 23/087 49/490.1

(Continued)

FOREIGN PATENT DOCUMENTS

DE 2313978 A1 * 11/1974 ..... F25D 23/02
DE 3525538 A1 * 1/1987 ..... F25D 23/082

(Continued)

*Primary Examiner* — Andrew M Roersma
(74) *Attorney, Agent, or Firm* — Dority & Manning, P.A.

(57) ABSTRACT

A refrigerator appliance is provided herein. The refrigerator appliance may include a cabinet defining a food storage chamber and a door rotatably attached to the cabinet. The door may be movable between an open position permitting access to the food storage chamber and a closed position restricting access to the food storage chamber. The door may include a molded support body, an interior panel, and a gasket. The molded support body may extend across an opening of the cabinet in the closed position and along an interface perimeter of the door. The interior panel may be attached to the molded support body.

19 Claims, 15 Drawing Sheets

(56) References Cited

U.S. PATENT DOCUMENTS

| | | | | |
|---|---|---|---|---|
| 7,766,436 | B1 * | 8/2010 | Steinkuhl | F25D 23/02 312/204 |
| 8,230,647 | B2 * | 7/2012 | Cho | F25D 23/02 49/489.1 |
| 9,605,891 | B2 | 3/2017 | Lee et al. | |
| 9,702,614 | B2 | 7/2017 | Lim | |
| 9,863,690 | B1 * | 1/2018 | Demiroez | E06B 3/70 |
| 2006/0254481 | A1 * | 11/2006 | Lee | F25D 25/02 108/108 |
| 2010/0229593 | A1 * | 9/2010 | Nam | F25D 23/028 62/449 |
| 2016/0305706 | A1 * | 10/2016 | Lim | F25D 23/025 |

FOREIGN PATENT DOCUMENTS

| | | | | |
|---|---|---|---|---|
| DE | 3525540 | A1 * | 1/1987 | F25D 23/082 |
| EP | 1074804 | A2 * | 2/2001 | B29C 45/16 |
| KR | 102006009808 | A * | 9/2006 | F25D 23/06 |

* cited by examiner

REFRIGERATOR APPLIANCE AND DOOR ASSEMBLY HAVING AN INTERIOR PANEL

FIELD OF THE INVENTION

The present subject matter relates generally to refrigerator appliances, and more particularly to refrigerator appliances having one or more separate panels attached to an inner door portion of a refrigerator appliance.

BACKGROUND OF THE INVENTION

Refrigerator appliances generally include a cabinet that defines a food storage chamber. In addition, refrigerator appliances also generally include a door rotatably hinged to the cabinet to permit selective access to food items stored in the food storage chamber. Certain refrigerator appliances, commonly referred to as door-in-door refrigerator appliances, may also include an outer door rotatably hinged to the inner door to permit selective access to the food storage chamber or, alternatively, a food storage chamber positioned between the inner and outer doors. In addition, door-in-door appliances may also include a gasket positioned on the outer door. Thus, when the outer door is in the closed position, the gasket seals against the inner door to enclose the food storage chamber.

For some refrigerator appliances, a door is provided that includes multiple attached pieces. In some instances, it may be desirable for certain pieces to be formed from a different material from the rest of the door and provide a surface that enhances the appearance and usability of the door. In order to join the separate pieces panel to the rest of the door, some existing refrigerator appliances use one or more adhesives. However, this configuration may present a number of issues or drawbacks, especially for pieces forming an inner surface of the door. As an example, the material of an inner surface may expand/contract at a different rate than the piece or material to which it is attached (e.g., by an adhesive). Over time, the difference in expansion/contraction may deteriorate the bond between the adhesive, door, and separate panel. Even if adhesives are not used, the separate panel may bend or buckle as it expand/contracts differently from the rest of the door.

Accordingly, further improvements are necessary to address one or more of the above-identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a food storage chamber and a door rotatably attached to the cabinet. The door may be movable between an open position permitting access to the food storage chamber and a closed position restricting access to the food storage chamber. The door may include a molded support body, an interior panel, and a gasket. The molded support body may extend across an opening of the cabinet in the closed position and along an interface perimeter of the door. The interior panel may be attached to the molded support body. The interior panel may include an inner surface and a plurality of tabs extending towards the interface perimeter. The inner surface may extend across the interface perimeter between the molded support body and the food storage chamber. The gasket may be positioned on the plurality of tabs along the interface perimeter.

In another exemplary aspect of the present disclosure, a refrigerator appliance is provided. The refrigerator appliance may include a cabinet defining a food storage chamber and a door rotatably attached to the cabinet. The door may be movable between an open position permitting access to the food storage chamber and a closed position restricting access to the food storage chamber. The door may include a molded support body and an interior panel. The molded support body may extend across an opening of the cabinet in the closed position to define an interface perimeter. The molded support body may define a fastener aperture to receive a screw fastener. The molded support body may include a bossing extending in a transverse direction about the fastener aperture. The interior panel may be attached to the molded support body. The interior panel may include an inner surface extending across the interface perimeter between the molded support body and the food storage chamber. The interior panel may define a bounding aperture through which the bossing extends.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
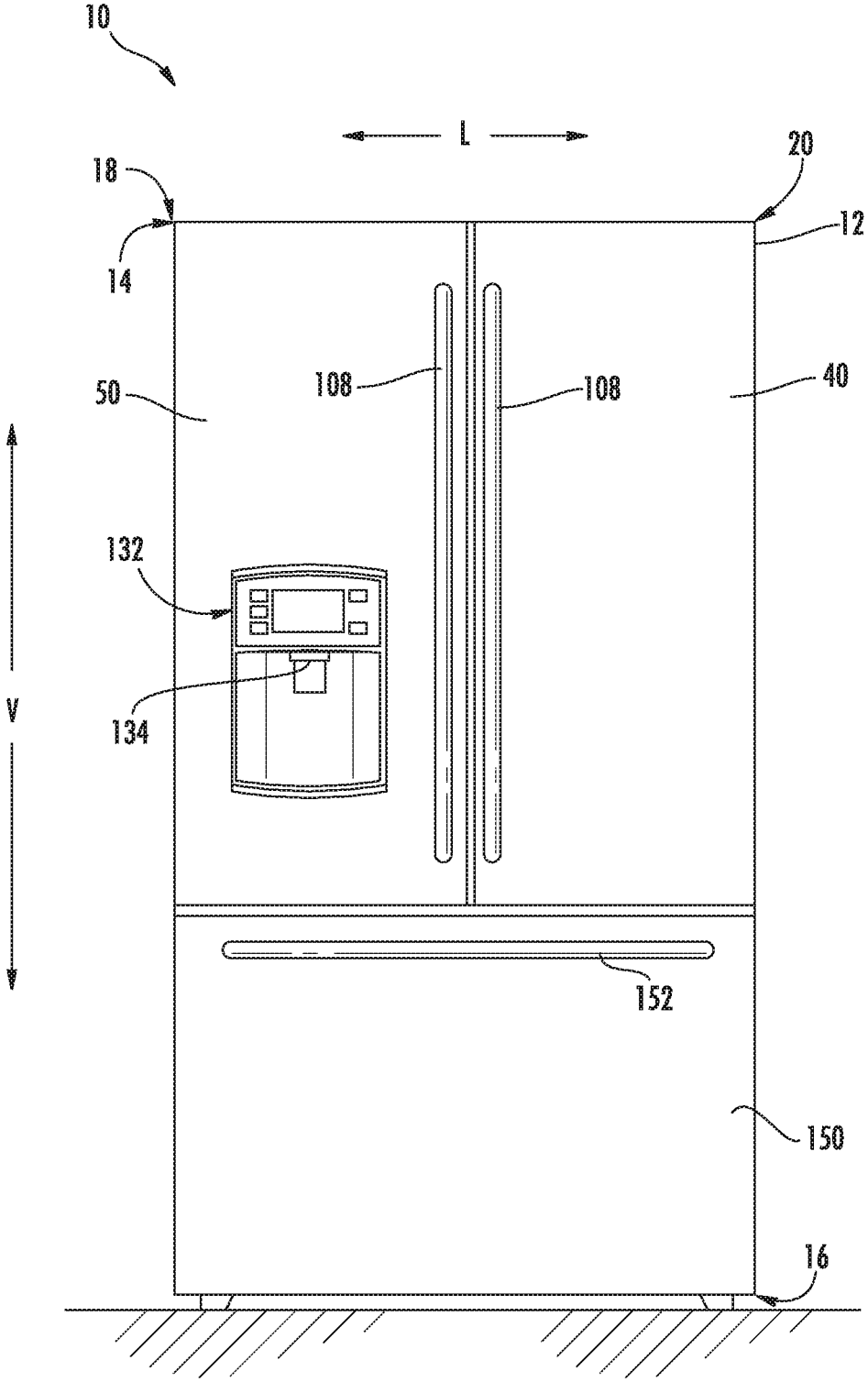
FIG. 1 provides a front elevation view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component or position from another and are not intended to signify an absolute location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein. The terms "includes" and "including" are intended to be inclusive in a manner similar to the term "comprising." Similarly, the term "or" is generally intended to be inclusive (i.e., "A or B" is intended to mean "A or B or both"). The phrase "in one embodiment," does not necessarily refer to the same embodiment, although it may.

Figure 2:
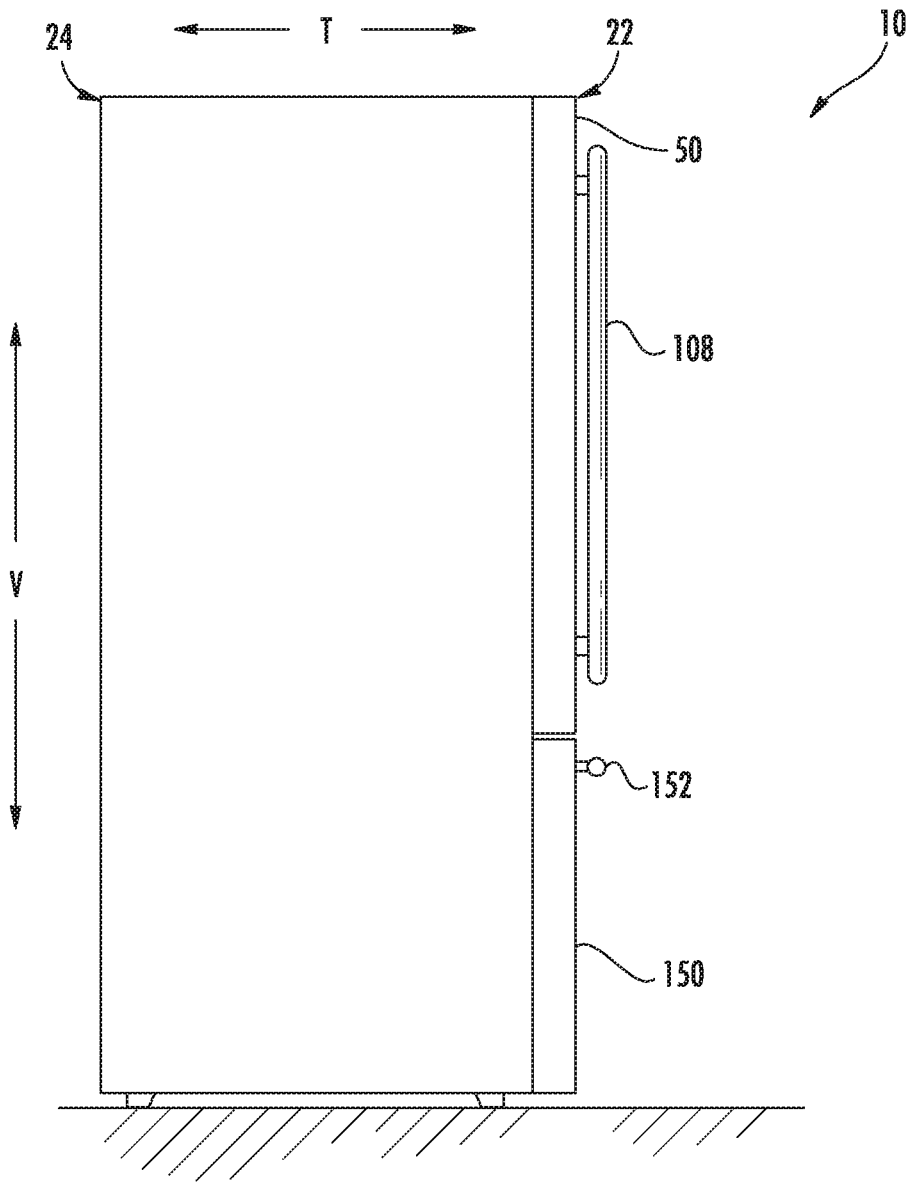
FIG. 2 provides a side view of the exemplary refrigerator appliance of FIG. 1.
Figure 3:
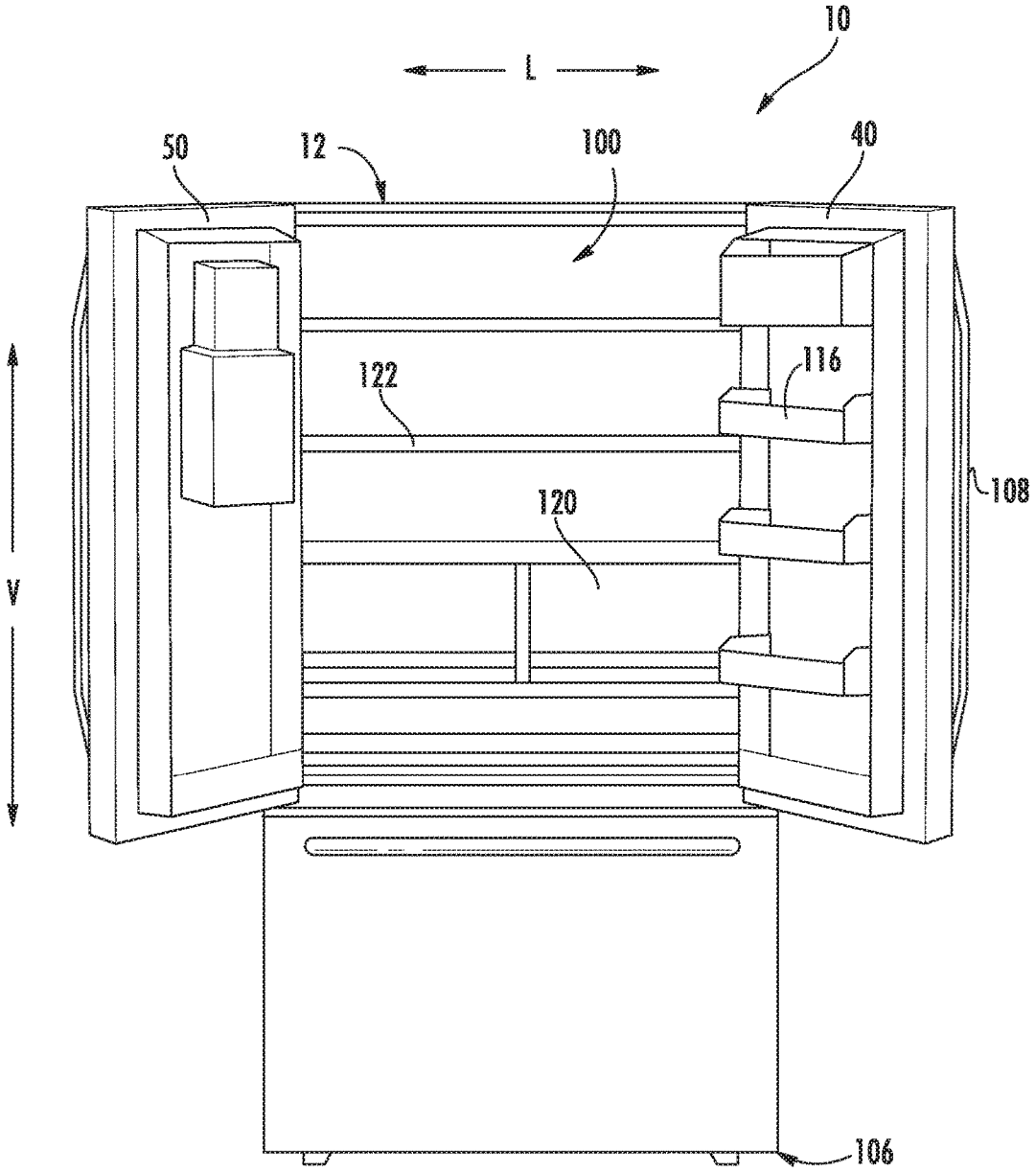
FIG. 3 provides a perspective view of the exemplary refrigerator appliance of FIG. 1.

Referring now to FIGS. 1 through 3, a refrigerator appliance 10 according to an embodiment of the present subject matter defines a vertical direction V, a lateral direction L, and a transverse direction T, each mutually perpendicular to one another. As may be seen, the refrigerator appliance 10 includes a housing or cabinet 12 that extends between a top 14 and a bottom 16 along the vertical direction V, between a left side 18 and a right side 20 along the lateral direction L, and between a front side 22 and a rear side 24 along the transverse direction T.

The cabinet 12 generally defines a food storage chamber 100 for receipt of food items for storage. In particular, the food storage chamber 100 is positioned at or adjacent the top 14 of the cabinet 12. It should be appreciated, however, that the food storage chamber 100 may be positioned at any suitable location within the refrigerator appliance 10. For example, in one embodiment, the food storage chamber 100 may extend from top 14 to bottom 16 along the vertical direction V.

The refrigerator appliance 10 may include one or more refrigerator doors 40, 50 rotatably mounted to the cabinet, for example, such that the refrigerator doors 40, 50 permit selective access to the food storage chamber 100. As shown, in some embodiments, the refrigerator doors 40, 50 include a right refrigerator door 40 and a left refrigerator door 50. The right refrigerator door 40 may be rotatably mounted to the cabinet 12 at the right side 20 of the cabinet 12. The left refrigerator door 50 may be rotatably mounted to the left side 18 of the cabinet 12. A handle 108 may be positioned on each of the refrigerator doors 40, 50 to facilitate movement of the doors 40, 50 between a fully closed position (FIG. 1) and a fully open position (FIG. 3).

The refrigerator appliance 10 may also include a dispenser assembly 132 for dispensing liquid water or ice. The dispenser assembly 132 includes a dispenser 134 positioned on or mounted to an exterior portion of the refrigerator appliance 10 (e.g., on the left refrigerator door 50). In addition, the refrigerator appliance 10 may include a freezer drawer 150 arranged below the refrigerator doors 40, 50 for selectively accessing items within a frozen food storage chamber (not shown). The freezer drawer 150 may include a handle 152 that is slidably mounted to the cabinet 12. Accordingly, the freezer drawer 150 may be moved in and out of the frozen food storage chamber (not shown) along the transverse direction T.

As shown in FIG. 3, various storage components may be mounted within the food storage chamber 100 to generally facilitate storage of food items. In certain embodiments, the storage components include bins 116, drawers 120, and shelves 122 that are mounted within the fresh food chamber 100. The bins 116, drawers 120, and shelves 122 are configured for receipt of food items (e.g., beverages or solid food items) and may assist with organizing such food items.

Referring now to FIGS. 4 through 7, the refrigerator appliance 10 may be configured as a door-in-door refrigerator. In particular, the right refrigerator door 40 may be replaced with a nested door assembly comprising an outer door 102 and an inner door 105. In another embodiment, the left refrigerator door 50 may be replaced with the nested door assembly. In yet another alternative embodiment, both refrigerator doors 40, 50 may be replaced with the nested door assembly.

The inner door 105 may include an outer surface 128 and an opposing inner surface 130, and the inner door 105 may be rotatably hinged to the cabinet 12, e.g., such that the inner door 105 is movable between a closed position (FIG. 1) and an open position (FIG. 4) to permit selective access to the food storage chamber 100 of the cabinet 12 (FIG. 1). In particular, the inner door 105 may be mounted to the cabinet 12 at the right side 20 (FIG. 1) of the cabinet 12. The inner door 105 may define an opening extending through the outer and inner surfaces 128, 130 and into the food storage chamber 100. Moreover, the inner door 105 may include a frame 106. As shown, the frame 106 may be positioned on the interior surface 130 of the inner door 105, and the frame 106 may extend around a perimeter of the opening defined by the inner door 105. Optionally, the frame 106 may extend into the fresh food storage chamber 100 when the inner door 105 is in the closed position.

Figure 4:
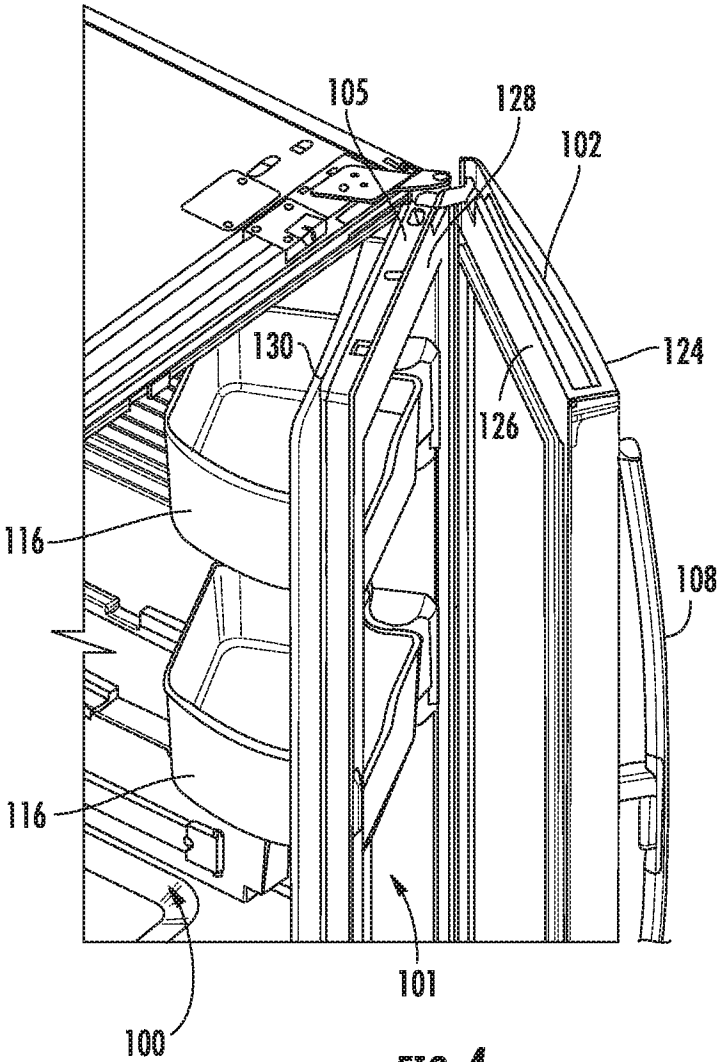
FIG. 4 provides a perspective view of a portion of a refrigerator appliance according to exemplary embodiments of the present disclosure.
Figure 6:
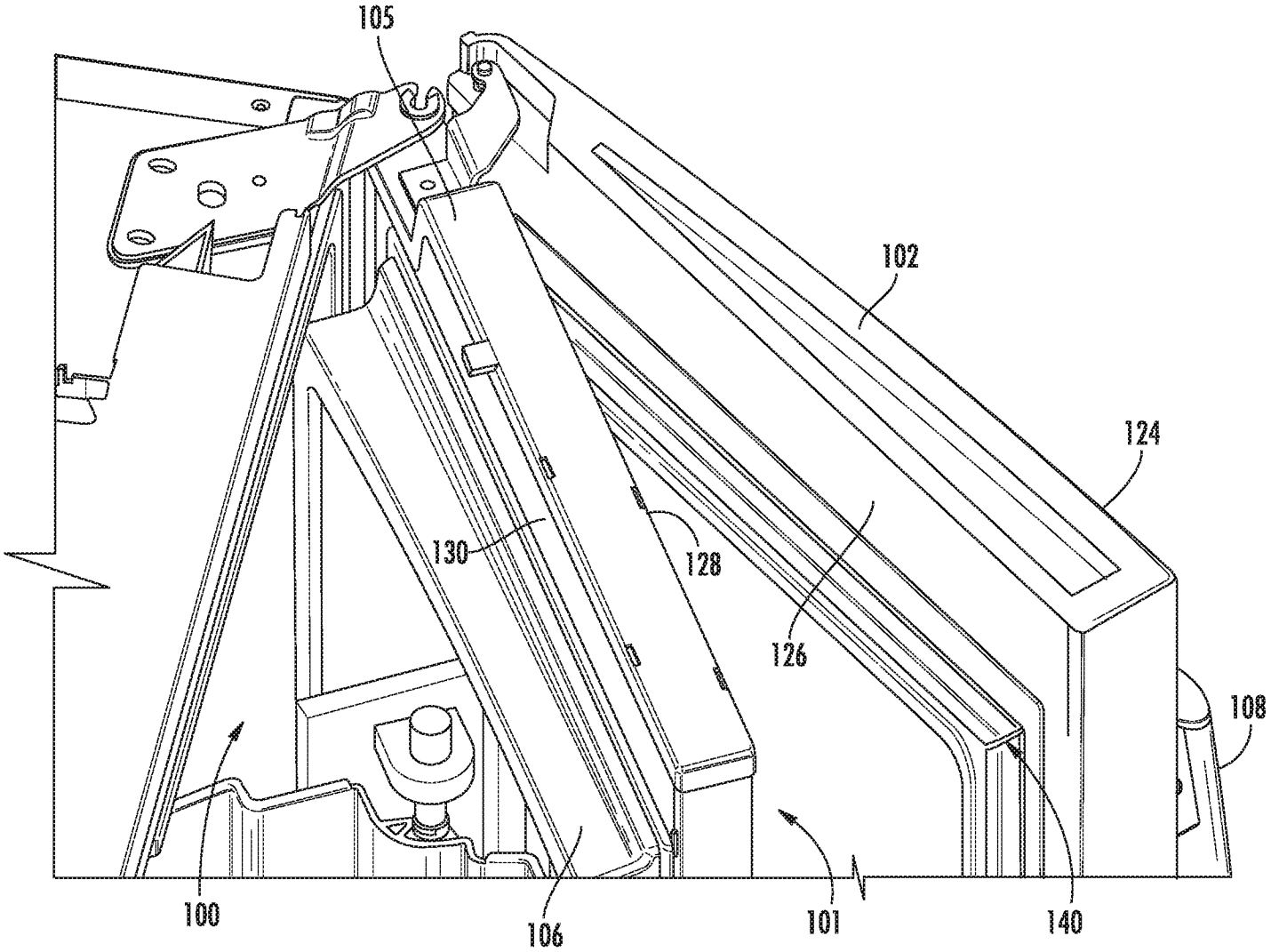
FIG. 6 provides another perspective view of a portion of the exemplary refrigerator appliance of FIG. 4.
Figure 7:
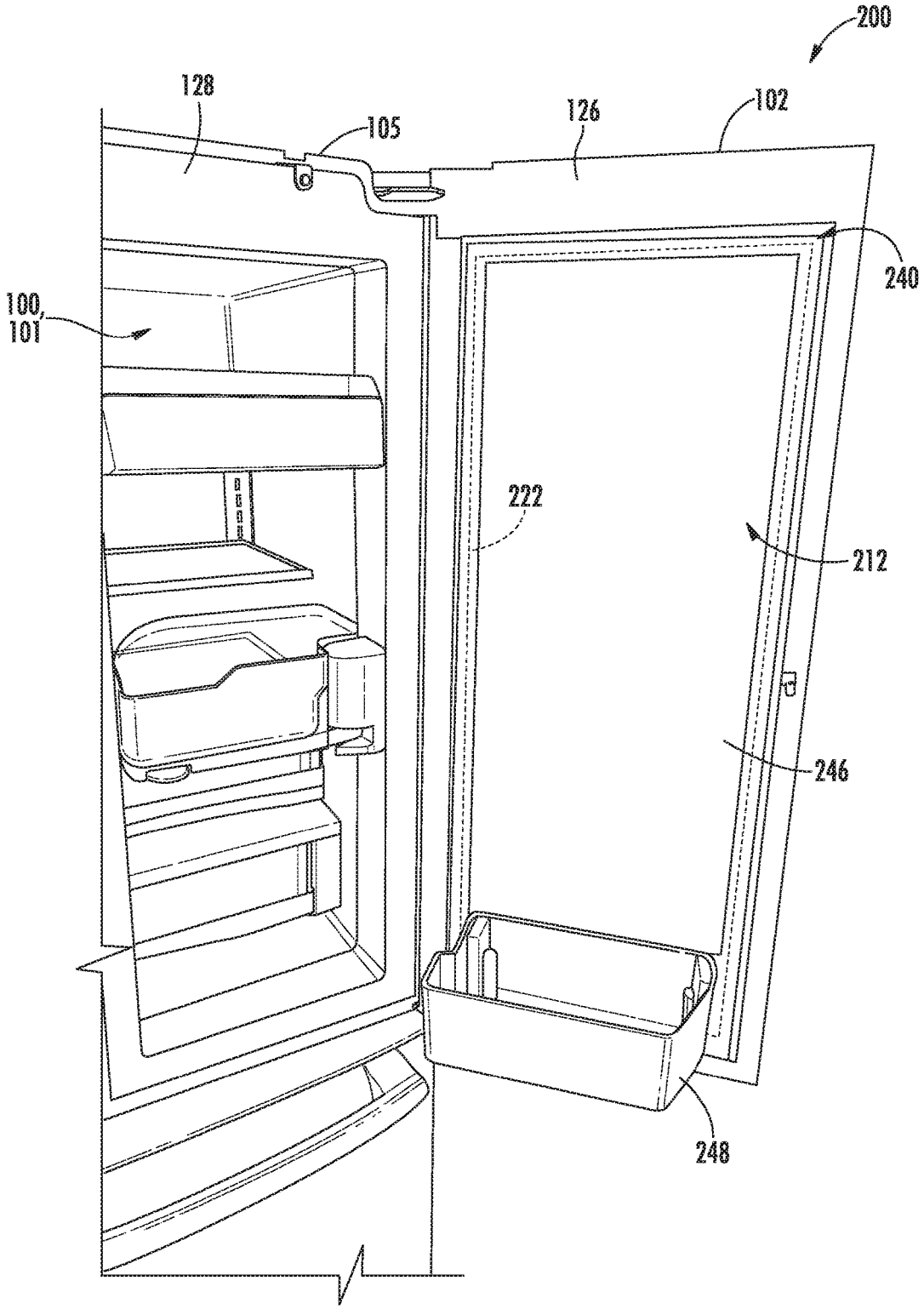
FIG. 7 provides yet another perspective view of a portion of the exemplary refrigerator appliance of FIG. 4.
Figure 8:
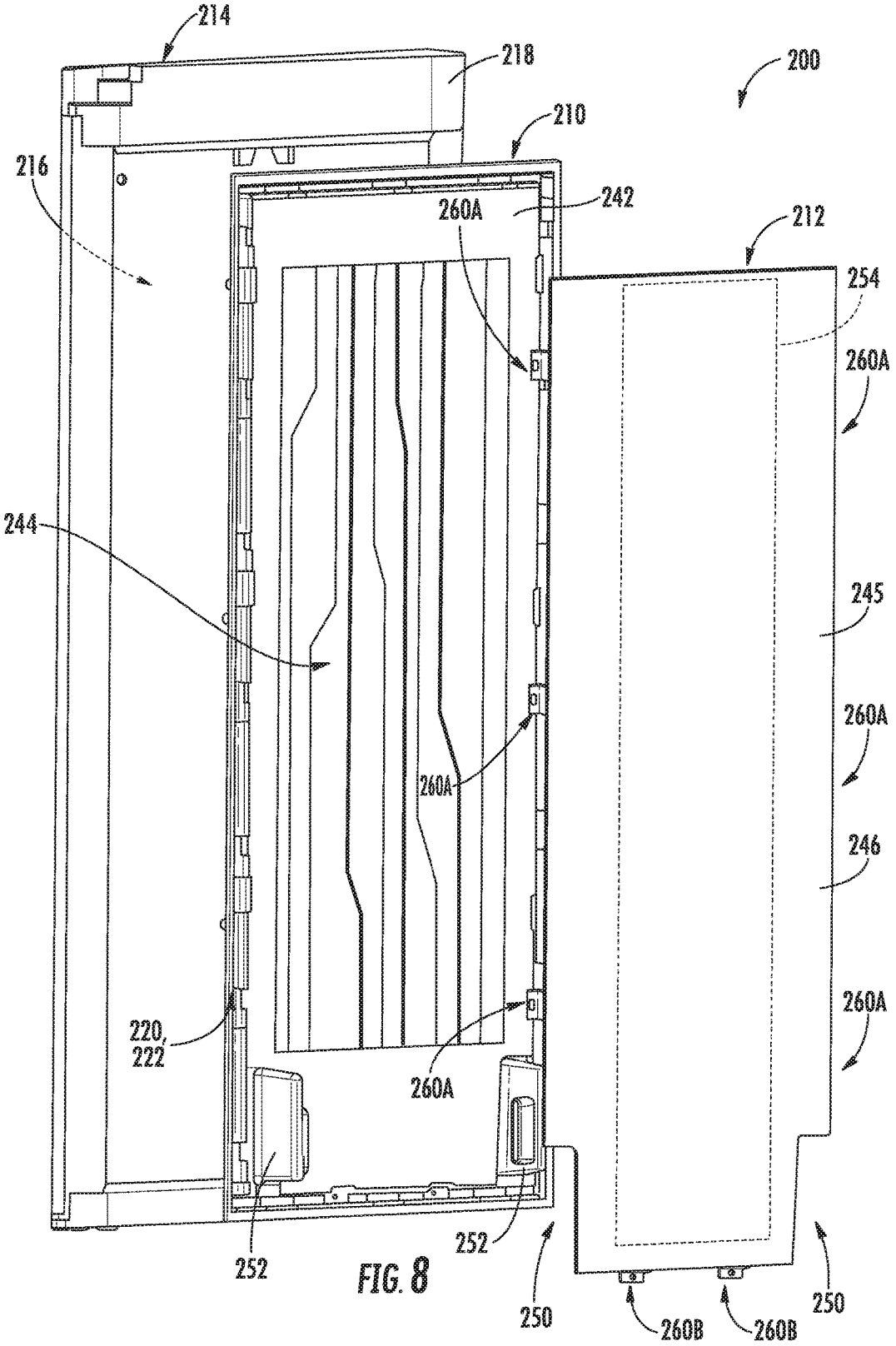
FIG. 8 provides an exploded view of a portion of a door of a refrigerator appliance according to exemplary embodiments of the present disclosure.
Figure 9:
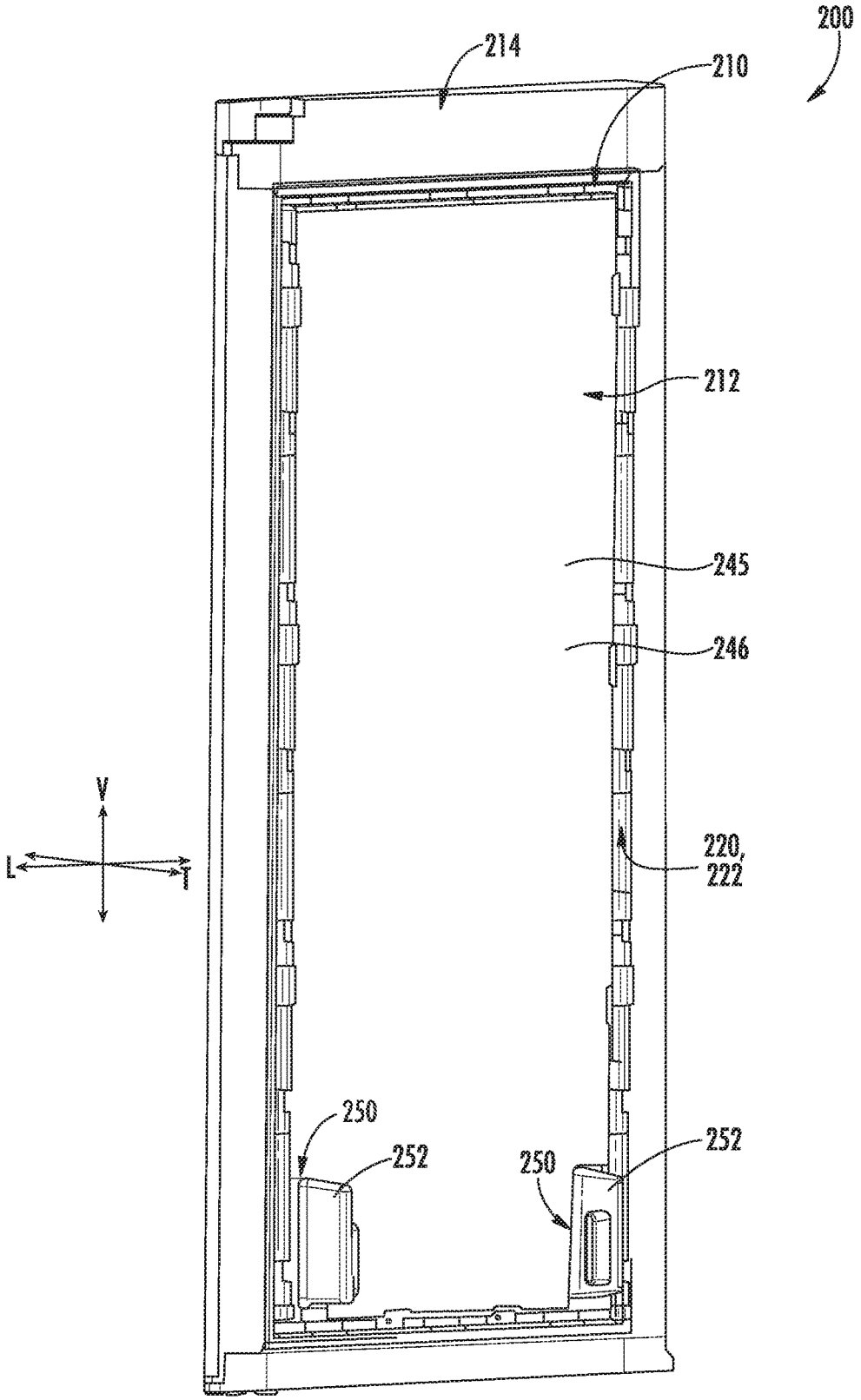
FIG. 9 provides an assembled perspective view of the exemplary portion of the door of FIG. 8.
Figure 10:
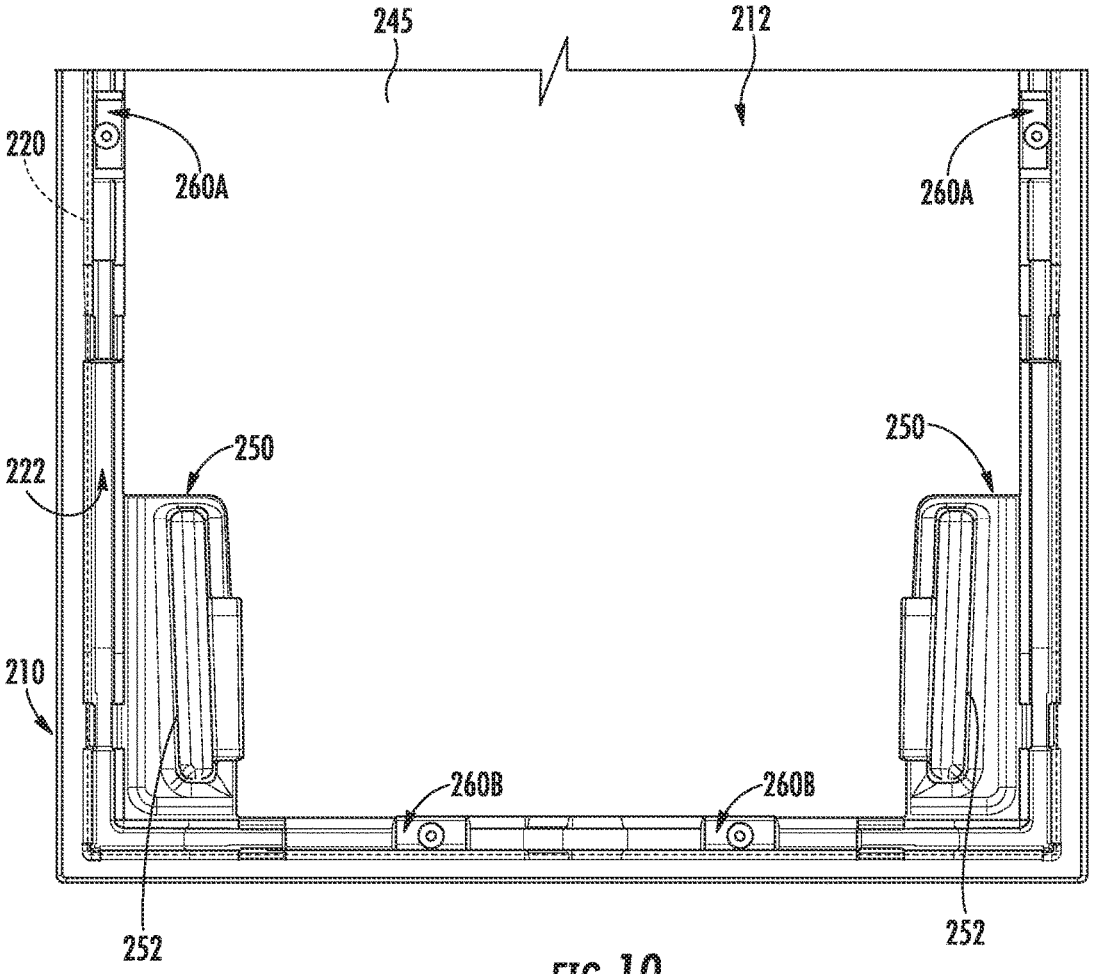
FIG. 10 provides an enlarged view of a portion of the exemplary door of FIG. 9.

The outer door 102 of the nested door assembly may include an outer surface 124 and an opposing inner surface 126. As shown, the outer door 102 may be rotatably hinged to the inner door 105, and the outer door 102 may be movable between a closed position (FIG. 1) and an open position (FIG. 4). In some embodiments, the outer door 102 is movable to permit selective access to a portion of the food storage chamber 100 through the opening defined by the inner door 105. In additional or alternative embodiments, a portion of the outer door 102 can be received within the frame 106 of the inner door 105 to define a second food storage chamber 101. In particular, the second food storage chamber 101 may be contiguous with the food storage chamber 100. It should be appreciated, however, that the second food storage chamber 101 may be isolated from the food storage chamber 100 in alternative embodiments. For example, the second storage chamber 101 may be a cavity defined in the outer surface 128 of the inner door 105. In particular, the cavity may not extend through the inner surface 130 of the inner door 105 and, as a result, may be isolated from the food storage chamber 100.

It should be appreciated that the outer and inner doors 102, 105 can generally move in the same direction. Specifically, the outer and inner doors 102, 105 may each move away from the food storage chamber 100 when moving towards their respective open positions or the fully open position. Moreover, the outer and inner doors 102, 105 may each move towards the food storage chamber 100 when moving towards their respective closed positions or the fully closed position.

In some embodiments, the refrigerator appliance 10 also includes a gasket 140 positioned on the inner surface 126 of the outer door 102. As the outer door 102 moves towards the closed position, the outer door 102 may compress the gasket 140 against the outer surface 128 of the inner door 105. Specifically, the gasket 140 may seal against the outer surface 128 of the inner door to enclose the food storage chamber 100 or, alternatively, the second food storage chamber 101. In alternative embodiments, the gasket 140 may be positioned on the outer surface 128 of the inner door 105 and, as the outer door 102 moves towards the closed position, the inner door 105 may compress the gasket 140 against the inner surface 126 of the outer door 102. More specifically, the gasket 140 may seal against the inner surface 126 of the outer door 102. It should be appreciated that the gasket 140 may be comprised of any suitable material. For example, in one embodiment, the gasket 140 may be comprised of a resilient rubber or plastic material.

Figure 5:
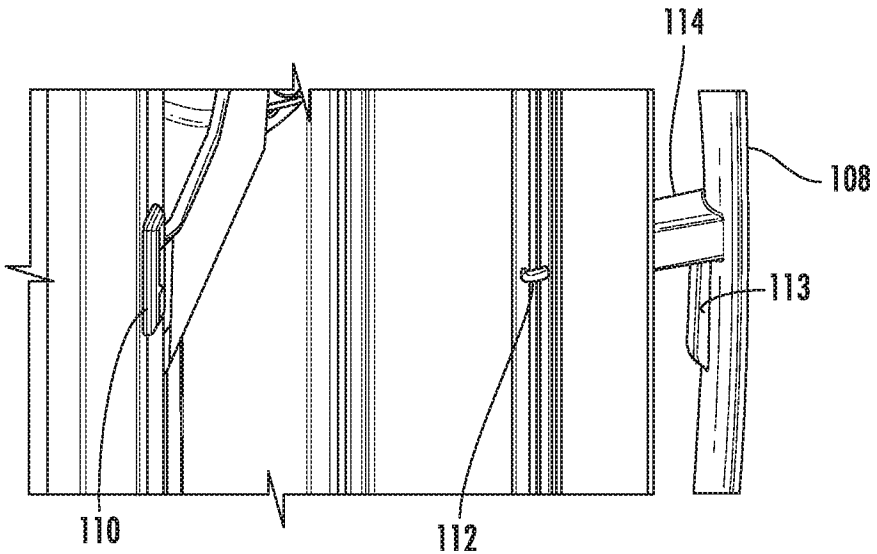
FIG. 5 provides an enlarged view of a portion of FIG. 4.

In optional embodiments, the refrigerator appliance 10 also includes a locking assembly to lock the outer and inner doors 102, 105 together. For example, as shown in FIGS. 4 and 5, the locking assembly may include a catch 110 provided on the inner door 105 and a latch 112 provided on the outer door 102. In addition, a handle 108 positioned on the outer door 102 may include a button or trigger 113 operably coupled with the latch 112. In addition, a latch housing 114 may be mounted to the handle 108, and both the latch 112 and the trigger 113 may, at least in part, be positioned within the latch housing 114.

In operation, a user may grasp the handle 108 of the outer door 102, pull the trigger 113 to release the latch 112 from the catch 110 and thereby unlock the outer door 102 from the inner door 105. When the outer door 102 is unlocked from the inner door 105, the outer door 102 may rotate independent of the inner door 105. As such, a user may access the bins 116 without opening the inner door 105. Alternatively, operating the handle 108 without pulling the trigger 113 permits opening the outer 102 and the inner door 105 together for full access to the food storage chamber 100.

Turning now generally to FIGS. 7 through 16, FIGS. 8 and 9 provide an exploded and an assembled view, respectively, of a door assembly 200. As shown, for instance in FIG. 7, the outer door assembly 200 may be provided as at least a portion of outer door 102, described above. FIGS. 11 through 16 illustrate various portions of door assembly 200 according to exemplary embodiments, as will be described in detail below.

With respect to FIGS. 7 through 16, the referenced directions (e.g., vertical direction V, lateral direction L, and transverse direction T) are understood to relate to a door (e.g., outer door 102) in the closed position. Therefore, vertical direction V, lateral direction L, and transverse direction T discussed below are understood to correspond to the same vertical direction V, lateral direction L, and transverse direction T described above when outer door 102 is in the closed position, as illustrated in FIGS. 1 and 2.

In some embodiments, door assembly 200 includes a molded support body 210 and a separate interior panel 212. When assembled, molded support body 210 and interior panel 212 may be joined to a solid or non-permeable exterior frame 214, which defines at least a portion of outer surface 124 (FIG. 4). For instance, exterior frame 214 may include an outer panel 216 defining outer surface 124 and formed from a suitable material, such as stainless steel, painted steel, or plastic. Outer panel 216 may be joined to, or integral with, a base framework or skeleton 218.

In exemplary embodiments, molded support body 210 is provided as a separate member from outer frame 214 that is attached to outer frame 214. For instance, molded support body 210 may be a molded member formed of a first material. Optionally, the first material may be a suitable polymer (e.g., a rigid acrylonitrile butadiene styrene) fixed to outer frame 214. In particular, molded support body 210 may be attached to a side of outer frame 214 opposite outer surface 124 (FIG. 4) via one or more suitable adhesives or fasteners (e.g., clips, screws, brackets, etc.). In turn, molded support body 210 generally rotate as part of outer door 102 (FIG. 4) between the open position and the closed position thereof. Moreover, molded support body 210 defines an interface perimeter 220 extending thereabout. Interface perimeter 220 may be defined at a radial extreme (e.g., extreme in the vertical direction V and lateral direction L in the closed position). Additionally or alternatively, interface perimeter 220 may be matched or aligned with (e.g., along the transverse direction T) a corresponding perimeter or frame of inner door 105 (e.g., at outer surface 128—FIG. 4), such that interface perimeter 220 extends about an opening of inner door 105 when inner door 105 and outer door 102 are closed together. When outer door 102 is in the closed position, molded support body 210 extends across at least a portion of the opening of inner door 105. For instance, molded support body 210 may extend across all or some of second food storage chamber 101 (FIG. 4).

As shown, molded support body 210 defines a continuous groove 222 that extends about a middle segment 242 of molded support body 210. For example, continuous groove 222 may provide a transverse recess that extends along (e.g., follows the same path as) interface perimeter 220. When assembled, a gasket 240 (e.g., embodied as gasket 140—FIG. 4) may cover all or some of continuous groove 222. Additionally or alternatively, continuous groove 222 may receive at least a portion of gasket 240.

In optional embodiments, an insulator (e.g., sprayed foam insulation) is provided between molded support body 210 and outer frame 214. In additional or alternative embodiments, one or more longitudinal grooves 244 may be defined (e.g., as an irregular waveform extending along the vertical direction V) within middle segment 242 of molded support body 210 (e.g., radially inward from interface perimeter 220). Notably, the one or more longitudinal grooves 244 may increase the rigidity of molded support panel 210 (e.g., when assembled) and prevent warping or buckling thereof.

In some embodiments, an interior panel 212 having a presentation body 245 is provided as part of door assembly 200. In particular, interior panel 212 may be attached (e.g., selectively or removably attached) to the molded support body 210. When assembled, interior panel 212 may generally rotate with the rest of outer door 102 (FIG. 4). In some such embodiments, the presentation body 245 of interior panel 212 defines an inner surface 246 (e.g., inner surface 126—FIG. 4) and extends across at least a portion of molded support body 210. Interior panel 212 may extend (e.g., along the vertical direction V or lateral direction L) across interface perimeter 220. In turn, interior panel 212 may extend from one vertical end of interface perimeter 220 to an opposite vertical end of interface perimeter 220, or interior panel 212 may extend from one lateral end of interface perimeter 220 to an opposite lateral end of interface perimeter 220. Interior panel 212 may span the entire portion or, alternatively, only a sub-portion of the middle segment 242. Moreover, interior panel 212 may hide or cover longitudinal grooves 244.

When outer door 102 (FIG. 4) is in the closed position, interior panel 212 may be positioned between molded support body 210 and, for example, food storage chamber 100 or 101 (FIG. 4) (e.g., along the transverse direction T). In optional embodiments, one or more storage containers (e.g., bin 248) are positioned between interior panel 212 and food storage chamber 100. For instance, a bin 248 may be attached to molded support body 210 to rotate therewith. At least a portion of interior panel 212 (e.g., inner surface 246) may be positioned between bin 248 and molded support body 210. For instance, a rear surface of bin 248 may engage (e.g., directly or indirectly contact) presentation body 245 (e.g., at inner surface 246). When assembled, one or more suitable fasteners (e.g., clips, screws, brackets, etc.) may extend from molded support body 210, through or around interior panel 212 along the transverse direction T, and to bin 248, thereby securing bin 248 to molded support body 210. In optional embodiments, one or more notches 250 (e.g., a pair of notches 250 spaced apart along the lateral direction L) define a corresponding transverse opening through interior panel 212 (e.g., within or radially inward from the interface perimeter 220). In the illustrated embodiments, a pair of container brackets 252 extends from molded support body 210 along the transverse direction T through a pair of corresponding notches 250 defined through interior panel 212. Bin 248 may be selectively mated or attached to container brackets 252 (e.g., by sliding thereon along the vertical direction V). Advantageously, bin 248 may hold or support interior panel 212 against molded support body 210 and restrict warping or buckling of interior panel 212. Additionally or alternatively, bin 248 may cover or hide at least a portion of the radial edges defined by interior panel 212.

As illustrated, interior panel 212 may be a generally solid or non-permeable member. For instance, presentation body 245 may define inner surface 246 as a contiguous or uninterrupted surface, through which the portions of door assembly 200 that are directly behind interior panel 212 along the transverse direction T (e.g., molded support body 210) are not visible. Additionally or alternatively, interior panel 212 may be formed from a rigid material (e.g., second material) that is unique or different from the material (e.g., first material) of the molded support body 210. For instance, interior panel 212 may include stainless steel, aluminum, a suitable polymer unique from the polymer of molded support body 210, or another suitable material. Notably, the second material of may be easier to clean or more durable than the first material that forms the rest of the door.

In optional embodiments, a foam backing 254 (e.g., one or more sheets of resilient, vibration-damping foam insulation) is positioned between molded support body 210 and interior panel 212. For instance, foam backing 254 may be disposed on a back surface of presentation body 245 (e.g., opposite inner surface 246 along the transverse direction T). One or more suitable adhesives or fasteners may secure foam backing 254 to presentation body 245. Additionally or alternatively, one or more applied coatings or structures (e.g., paint, ink, etc.) may be provided on interior panel 212 (e.g., at presentation body 245 or inner surface 246) to enhance, protect, or visually distinguish interior panel 212.

In some embodiments, interior panel 212 includes one or more tabs (e.g., indicated generally by 260) extending outward therefrom. As an example, a plurality of tabs 260A and 260B may extend radially (e.g., along the vertical direction V or lateral direction L) from presentation body 245. When assembled, tab(s) 260, 260A, or 260B may extend from presentation body 245 and toward interface perimeter 220. Optionally, a plurality of tabs 260A and 260B may be provided, each tab 260A and 260B being positioned at a discrete circumferential location (e.g., location along the perimeter of presentation body 245). In the exemplary embodiments of FIGS. 8 and 9, six lateral tabs (e.g., tabs 260A extending radially outward from presentation body 245 along the lateral direction L) and two vertical tabs (e.g., tabs 260B extending radially outward from presentation body 245 along the vertical direction V) are provided. However, additional or alternative embodiments may include any number of suitable tabs 260, 260A, or 260B.

Figure 11:
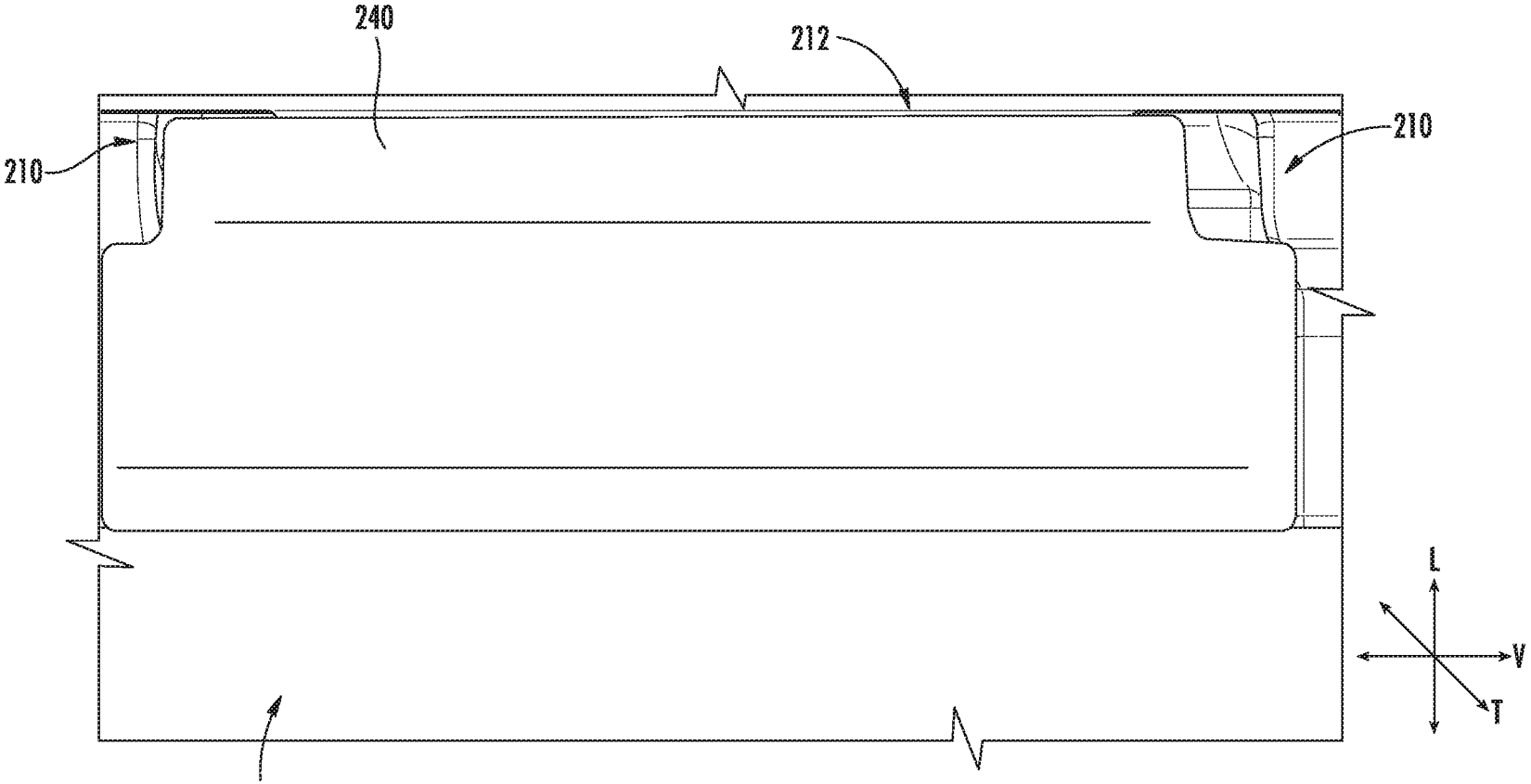
FIG. 11 provides a perspective view of a portion of the exemplary door of FIG. 9.
Figure 12:
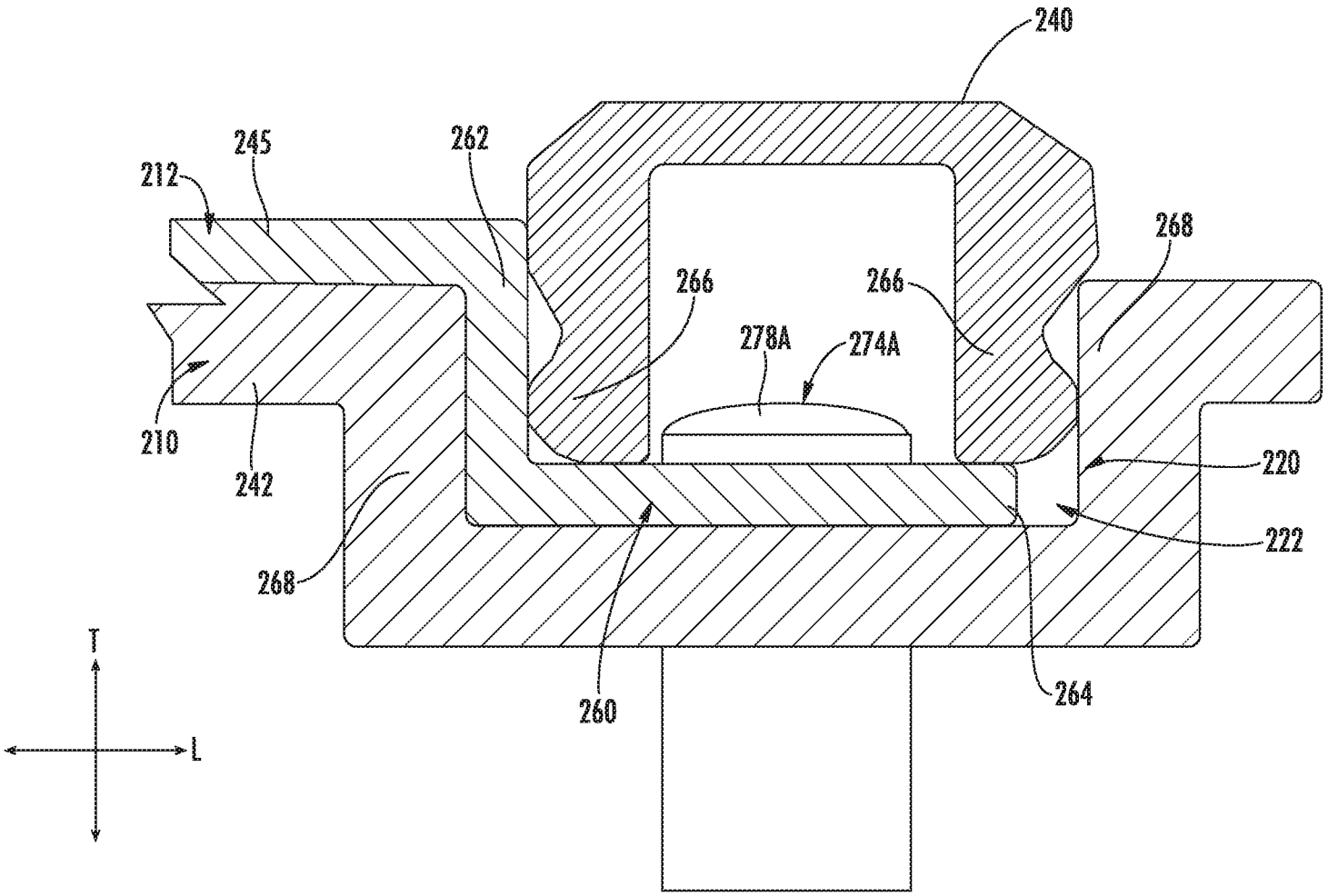
FIG. 12 provides a schematic, cross-sectional top view of the portion of the exemplary door of FIG. 11.
Figure 14:
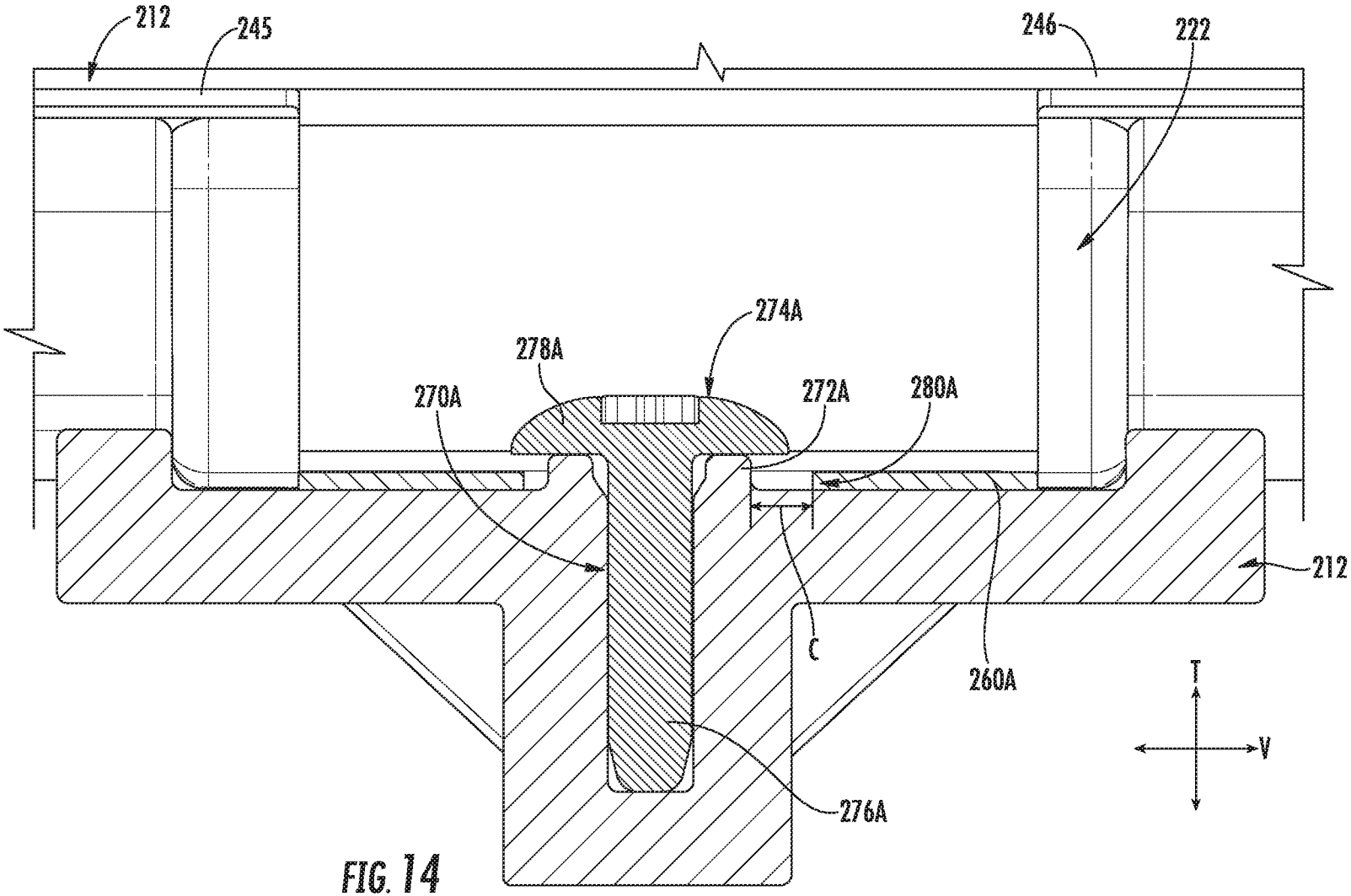
FIG. 14 provides a cross-sectional side view of the portion of the exemplary door of FIG. 13.
Figure 15:
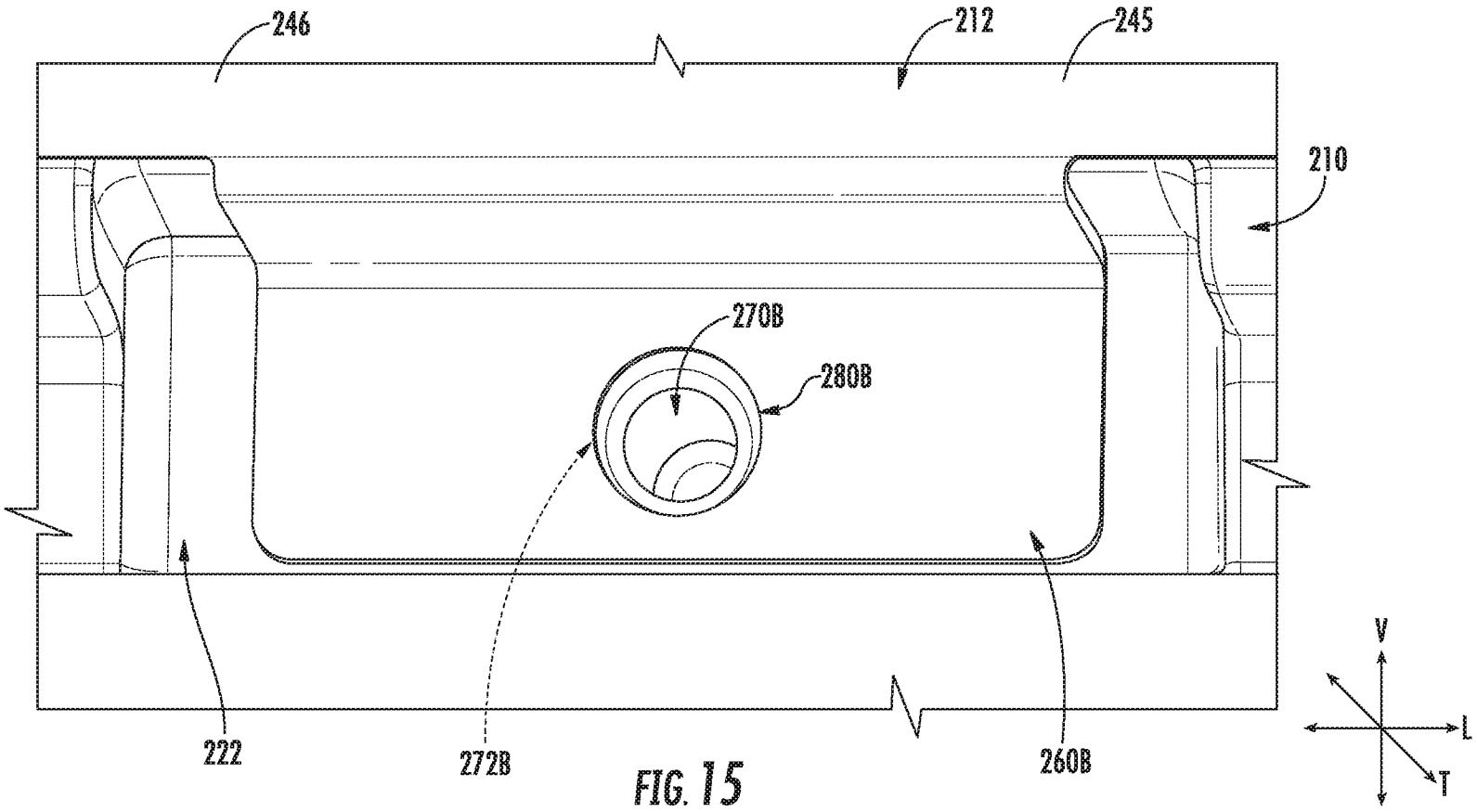
FIG. 15 provides a perspective view of another portion of the exemplary door of FIG. 9, wherein a gasket has been removed for clarity.
Figure 16:
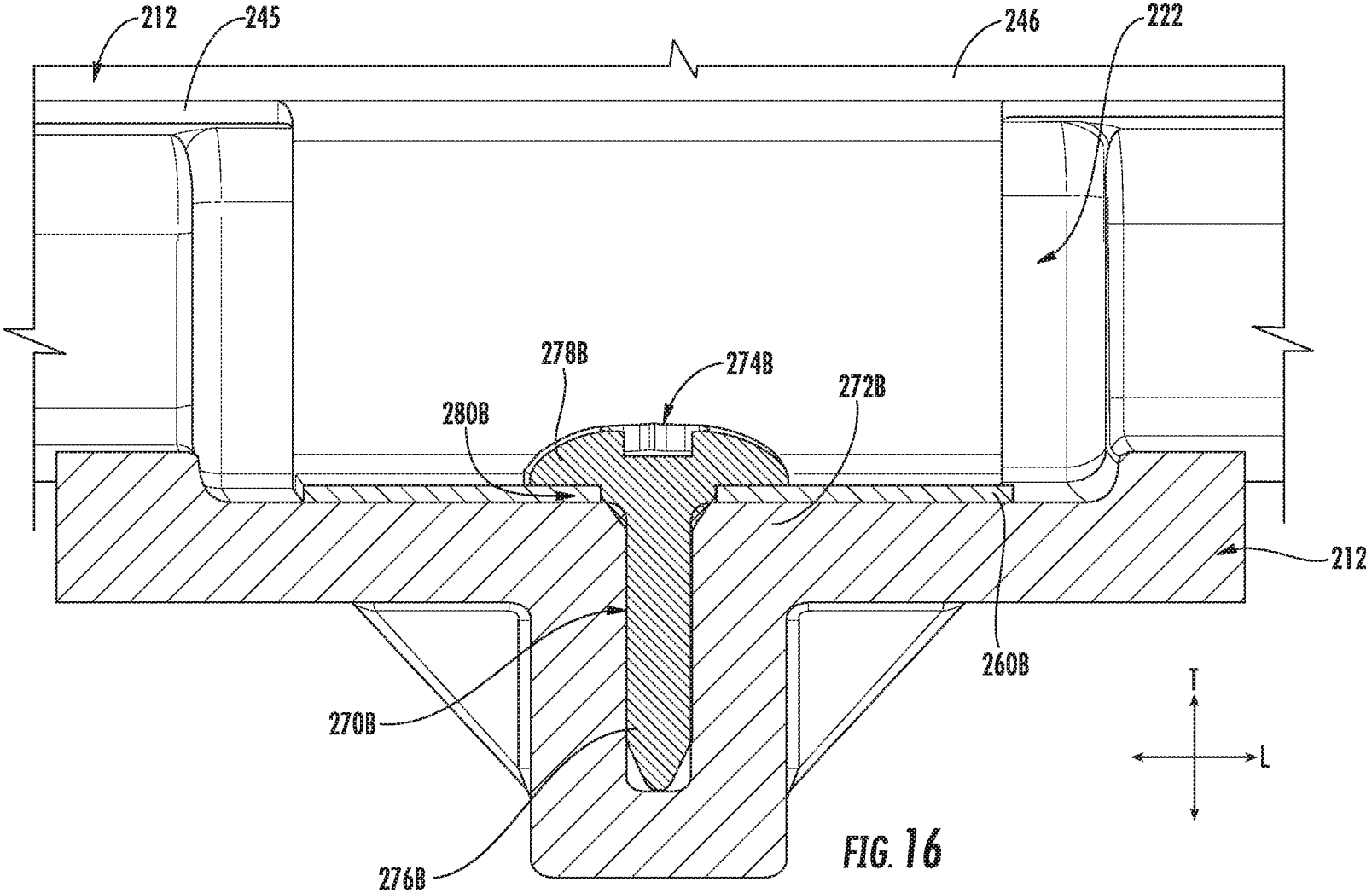
FIG. 16 provides a cross-sectional side view of a portion of the exemplary door of FIG. 15.

As illustrated generally in FIGS. 10 through 16, and especially in FIG. 12, through 16, certain embodiments include at least one tab 260 (e.g., a plurality of tabs 260A and 260B—FIGS. 8 and 9) that is recessed within continuous groove 222. For instance, a tab 260, 260A, or 260B may be bent or shaped to extend rearward from a radial base 262 on the presentation body 245 before being directed outward to a radial tip 264 within continuous groove 222. In other words, a transverse segment of tab 260, 260A, or 260B may extend from radial base 262 along the transverse direction T, and from the transverse segment, a radial segment may extend from the transverse segment (e.g., along the lateral direction L or vertical direction V) to the radial tip 264. In some embodiments, each tab 260 is generally shaped to match the profile of continuous groove 222. Optionally, the radial segment of tab 260, 260A, or 260B may be seated wholly within continuous groove 222.

In some embodiments, gasket 240 may selectively cover at least a portion of one or all of the tabs 260, 260A, 260B. For instance, as shown in FIGS. 11 and 12, gasket 240 may be positioned on tab 260 along the interface perimeter 220. In certain embodiments, a portion of gasket 240 sits within continuous groove 222. As an example, a pair of radial beads or darts 266 may be held in a removable friction fit against a pair of transverse walls 268 of continuous groove 222. The transverse segment of a tab 260, 260A, or 260B may thus be positioned between an inner radial bead or dart 266, while the radial segment of a tab 260, 260A, or 260B passes behind gasket 240 (e.g., between a gasket 240 and a rear portion of continuous groove 222 along the transverse direction T). Advantageously, the installed gasket 240 may cover or hide all or some of the radial edges defined by interior panel 212 (e.g., the radial edges not otherwise covered by bin 248).

Figure 13:
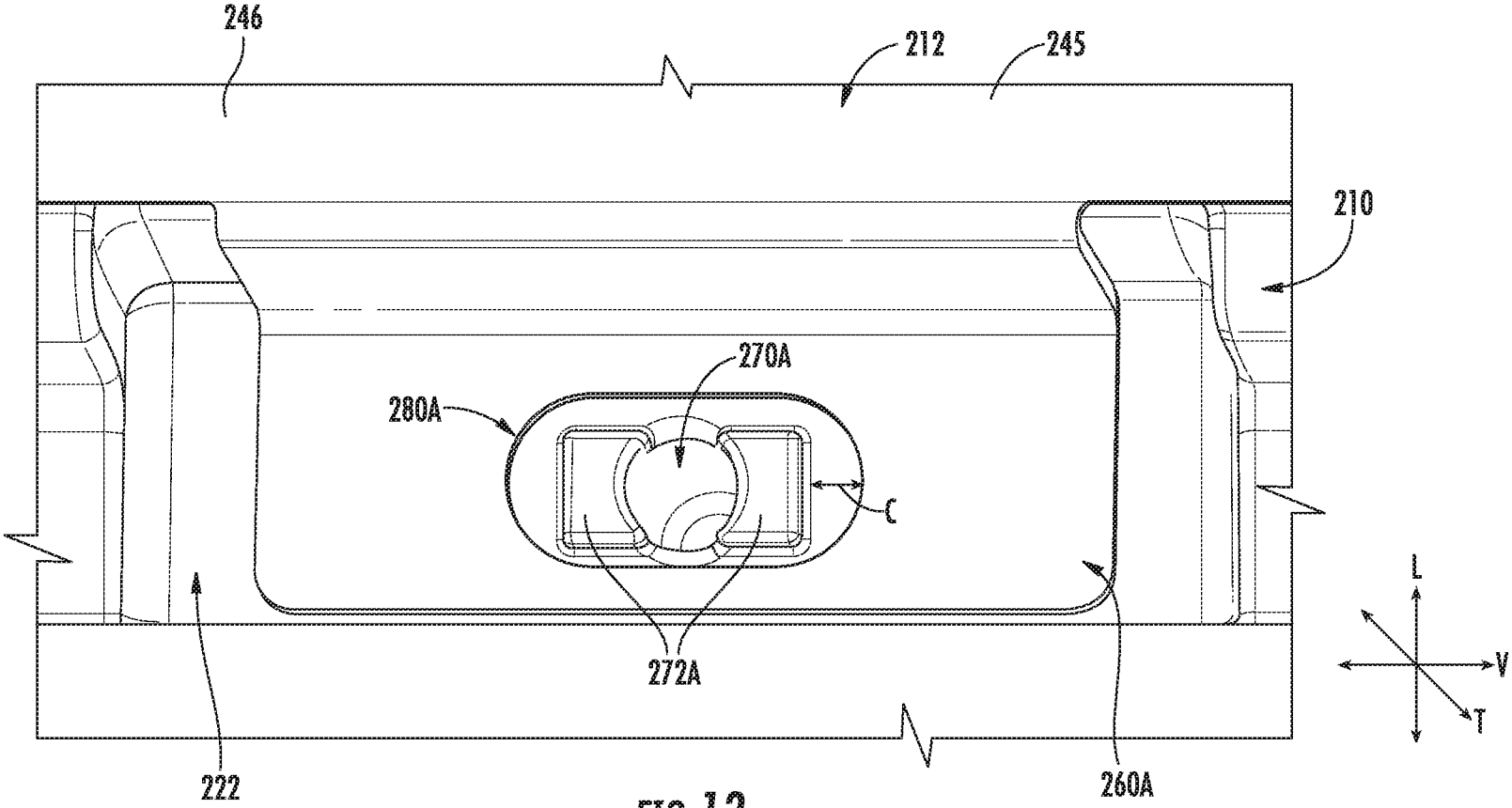
FIG. 13 provides a perspective view of a portion of the exemplary door of FIG. 9, wherein a gasket has been removed for clarity.

As illustrated, especially in FIGS. 13 and 14, molded support body 210 defines a fastener aperture 270A (e.g., to receive a removable screw 274A). Bounding one or more fastener apertures 270A, molded support body 210 may include a bossing 272. For instance, a bossing 272 may be formed about a discrete corresponding fastener aperture 270A. Moreover, bossing 272 may extend forward (e.g., along the transverse direction T) from the rear portion of continuous groove 222. At least a portion of bossing 272 may be coaxial with fastener apertures 270A. In exemplary embodiments, bossing 272 defines at least a portion of fastener aperture 270A. Optionally, bossing 272 may define a transverse length that is smaller than a transverse depth of continuous groove 222. When assembled, gasket 240 may be positioned in front of bossing 272.

In certain embodiments, at least one tab (e.g., tab 260A) of interior panel 212 defines a bounding aperture 280A. Optionally, multiple tabs may define bounding apertures 280A (e.g., each lateral tab 260A). When assembled, each bounding aperture 280A may receive a discrete corresponding bossing 272. In other words, a bossing 272 may extend through a corresponding bounding aperture 280A that is transversely aligned with the bossing 272. Thus, bossing 272 may extend along the transverse direction T from a location behind the corresponding tab 260A to a location in front of the corresponding tab 260A.

As shown, a corresponding screw 274A may be provided for fastener aperture 270A. The corresponding screw 274A may include a linear shaft 276A removably positioned within fastener aperture 270A (e.g., when assembled) and through bossing 272. An enlarged head 278A of screw 274A may be positioned in front of fastener aperture 270A, bossing 272, or tab 260A. In some such embodiments, the enlarged head 278A is assembled in engagement (e.g., direct contact) with bossing 272. A transverse spacing may be defined between the enlarged head 278A and tab 260A.

Bounding aperture 280A may have a width or diameter larger than a width or diameter of bossing 272, as well as a width or diameter of fastener aperture 270A. Additionally or alternatively, a width or diameter of bounding aperture 280A may be smaller than the diameter of the enlarged head 278A (e.g., such that transverse movement of tab 260A is restricted or limited by screw 274A). Generally, bounding aperture 280A may be formed as a void having a cross-section of any suitable shape, such as an ellipse (as illustrated), a circle, a rectangle, etc. In some embodiments, a predetermined radial clearance or spacing C is defined between the corresponding bossing 272 and bounding aperture 280A. In other words, a predetermined amount of space may be defined between an outermost surface of bossing 272 and a bounding aperture 280A (e.g., along the vertical direction V). In some such embodiments, the radial spacing C is between 0.010 inch and 0.100 inch at room temperature (e.g., between 60° Fahrenheit and 77° Fahrenheit).

As illustrated, especially in FIGS. 14 and 15, molded support body 210 defines another fastener aperture 270B (e.g., to receive a removable screw 274B) within an unbounded planar region 272B. Thus, the area radially outward from (e.g., immediately adjacent to) the entrance of fastener aperture 270B may be free of any protrusions or bossings extending forward from the rear region of continuous groove 222. Moreover, the unbounded planar region 272B may be formed as flat or planar surface to engage, for instance, a discrete corresponding tab 260B.

In certain embodiments, at least one tab 260B of interior panel 212 defines a non-bounding aperture 280B. Optionally, multiple tabs 260 260A 260B may define non-bounding aperture 280Bs (e.g., each vertical tab 260B). When assembled, each non-bounding aperture 280B may be transversely aligned (e.g., coaxial) with a discrete corresponding fastener aperture 270B. Thus, the corresponding fastener aperture 270B may be positioned entirely rearward from or behind the non-bounding aperture 280B.

As shown, a corresponding screw 274B may be provided for fastener aperture 270B. The corresponding screw 274B may include a linear shaft 276B removably positioned within fastener aperture 270B (e.g., when assembled). An enlarged head 278B of screw 274B may be positioned in front of fastener aperture 270B or tab 260B. In some such embodiments, the enlarged head 278B is assembled in engagement (e.g., direct or indirect contact) with tab 260B. The corresponding screw 274B may thus hold the tab 260B against molded support body 210 (e.g., against the unbounded planar region 272B).

Non-bounding aperture 280B may have a width or diameter larger than a width or diameter of fastener aperture 270B. Additionally or alternatively, the width or diameter of non-bounding aperture 280B may be smaller than the diameter of the enlarged head 278B (e.g., such that transverse movement of tab 260B is restricted or limited by screw 274B). Generally, non-bounding aperture 280B may be formed as a void having a cross-section of any suitable shape, such as a circle (as illustrated), an ellipse, a rectangle, etc.

Advantageously, in the above-described embodiments, thermal expansion at one element (e.g., the interior panel 212) may be permitted at a different rate than thermal expansion at another element (e.g., molded support body 210) without causing bending or buckling (e.g., at one or more tabs, presentation body 245, etc.). Additionally or alternatively, embodiments including a removable fastener (e.g., securing interior panel to molded support body 210) may advantageously permit convenient removal (e.g., for replacement or serve) of interior panel 212.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a food storage chamber; and a door rotatably attached to the cabinet, the door being movable between an open position permitting access to the food storage chamber and a closed position restricting access to the food storage chamber, the door comprising a molded support body extending across an opening of the cabinet in the closed position and along an interface perimeter of the door, an interior panel attached to the molded support body, the interior panel comprising an inner surface and a plurality of tabs extending towards the interface perimeter, the inner surface extending across the interface perimeter between the molded support body and the food storage chamber, and a gasket positioned on the plurality of tabs along the interface perimeter, wherein the molded support body defines a fastener aperture to receive a screw fastener, wherein the molded support body comprises a bossing extending in a transverse direction about the fastener aperture, wherein at least one tab of the plurality of tabs defines a bounding aperture through which the bossing extends, and wherein a predetermined radial clearance is defined between the bossing and the bounding aperture.

2. The refrigerator appliance of claim 1, wherein the molded support body comprises a first material, and wherein the interior panel comprises a second material, the second material being different from the first material.

3. The refrigerator appliance of claim 1, wherein the door further comprises a foam backing disposed on the on the interior panel opposite the inner surface between the interior panel and the molded body.

4. The refrigerator appliance of claim 1, wherein the fastener aperture is one fastener aperture of a plurality of fastener apertures, wherein the bossing is one bossing of a plurality of bossings, wherein the bounding aperture is one bounding aperture of a plurality of bounding apertures defined through discrete tabs of the plurality of tabs, and wherein each bossing of the plurality of bossings extends in the transverse direction about a discrete fastener aperture and through a discrete bounding aperture.

5. The refrigerator appliance of claim 4, wherein at least one other fastener aperture of the plurality of fastener apertures is defined within an unbounded planar region, wherein at least one other tab of the plurality of tabs is positioned on the unbounded planar region, and wherein the at least one other tab of the plurality of tabs defines a non-bounding aperture in transverse alignment with the at least one other fastener aperture.

6. The refrigerator appliance of claim 1, wherein the screw fastener comprises a linear shaft selectively positioned within the fastener aperture and an enlarged head extending from the linear shaft in front of the fastener aperture.

7. The refrigerator appliance of claim 6, wherein the enlarged head is positioned in direct contact with the bossing.

8. A refrigerator appliance comprising:

a cabinet defining a food storage chamber; and a door rotatably attached to the cabinet, the door being movable between an open position permitting access to the food storage chamber and a closed position restricting access to the food storage chamber, the door comprising a molded support body extending across an opening of the cabinet in the closed position to define an interface perimeter, the molded support body defining a fastener aperture to receive a screw fastener, the molded support body comprising a bossing extending in a transverse direction about the fastener aperture, and an interior panel attached to the molded support body, the interior panel comprising an inner surface extending across the interface perimeter between the molded support body and the food storage chamber, the interior panel defining a bounding aperture through which the bossing extends, wherein the interior panel further comprises a tab extending radially from the inner surface, wherein the bounding aperture is defined through the tab, wherein the molded support body defines a continuous Groove extending along the interface perimeter of the door, and wherein the tab is recessed within the continuous groove.

9. The refrigerator appliance of claim 8, wherein the molded support body comprises a first material, and wherein the interior panel comprises a second material, the second material being different from the first material.

10. The refrigerator appliance of claim 8, wherein the door further comprises a foam backing disposed on the on the interior panel opposite the inner surface between the interior panel and the molded body.

11. The refrigerator appliance of claim 8, wherein the fastener aperture is one fastener aperture of a plurality of fastener apertures, wherein the bossing is one bossing of a plurality of bossings, wherein the bounding aperture is one bounding aperture of a plurality of bounding apertures, and wherein each bossing of the plurality of bossings extends in the transverse direction about a discrete fastener aperture and through a discrete bounding aperture.

12. The refrigerator appliance of claim 8, wherein the door further comprises a gasket positioned on the tab along the interface perimeter.

13. The refrigerator appliance of claim 8, wherein the screw fastener comprises a linear shaft selectively positioned within the fastener aperture and an enlarged head extending from the linear shaft in front of the fastener aperture.

14. The refrigerator appliance of claim 13, wherein the enlarged head is positioned in direct contact with the bossing.

15. The refrigerator appliance of claim 8, wherein a predetermined radial clearance is defined between the bossing and the bounding aperture.

16. A refrigerator appliance comprising:

a cabinet defining a food storage chamber; and a door rotatably attached to the cabinet, the door being movable between an open position permitting access to the food storage chamber and a closed position restricting access to the food storage chamber, the door comprising a molded support body extending across an opening of the cabinet in the closed position to define an interface perimeter, the molded support body defining a fastener aperture to receive a screw fastener, the molded support body comprising a bossing extending in a transverse direction about the fastener aperture, and an interior panel attached to the molded support body, the interior panel comprising an inner surface extending across the interface perimeter between the molded support body and the food storage chamber, the interior panel defining a bounding aperture through which the bossing extends, wherein the screw fastener comprises a linear shaft selectively positioned within the fastener aperture and an enlarged head extending from the linear shaft in front of the fastener aperture, and wherein the enlarged head is positioned in direct contact with the bossing.

17. The refrigerator appliance of claim 16, wherein the fastener aperture is one fastener aperture of a plurality of fastener apertures, wherein the bossing is one bossing of a plurality of bossings, wherein the bounding aperture is one bounding aperture of a plurality of bounding apertures, and wherein each bossing of the plurality of bossings extends in the transverse direction about a discrete fastener aperture and through a discrete bounding aperture.

18. The refrigerator appliance of claim 16, wherein a predetermined radial clearance is defined between the bossing and the bounding aperture.

19. The refrigerator appliance of claim 16, wherein the door further comprises a foam backing disposed on the on the interior panel opposite the inner surface between the interior panel and the molded body.

* * * * *